US006598360B1

(12) United States Patent
Pratt

(10) Patent No.: US 6,598,360 B1
(45) Date of Patent: Jul. 29, 2003

(54) BASEMENT WATER DRAINAGE CONDUIT AND METHODS OF USE THEREOF

(76) Inventor: James M. Pratt, P.O. Box 920624, Needham, MA (US) 02492

( * ) Notice: Subject to any disclaimer, the term of this patent is extended or adjusted under 35 U.S.C. 154(b) by 0 days.

(21) Appl. No.: 10/033,567

(22) Filed: Jan. 2, 2002

Related U.S. Application Data

(60) Provisional application No. 60/255,792, filed on Dec. 18, 2000.

(51) Int. Cl.[7] ..... E02D 19/00

(52) U.S. Cl. ..... 52/169.5; 52/730.4; 52/731.2; 52/732.1

(58) Field of Search ..... 52/169.5, 730.4, 52/731.2, 732.1

(56) References Cited

U.S. PATENT DOCUMENTS 1,360,774 A * 11/1920 Mooney et al. ..... 52/731.2
2,941,635 A * 6/1960 Harris ..... 52/634
3,977,149 A * 8/1976 Haynes et al. ..... 52/732.1
4,171,598 A * 10/1979 Holmes ..... 52/118
5,501,044 A * 3/1996 Janesky ..... 52/169.5
5,715,643 A * 2/1998 Parkinson ..... 52/656.9
5,765,323 A * 6/1998 Bevilacqua ..... 52/169.5
6,052,959 A * 4/2000 LaBrosse ..... 52/302.6
6,202,366 B1 * 3/2001 Snyder et al. ..... 52/97

* cited by examiner

*Primary Examiner*—Jeanette Chapman
(74) *Attorney, Agent, or Firm*—William Nitkin

(57) ABSTRACT

A conduit is disclosed for installation under the floor of a basement for the removal of water therefrom, such conduit having an elongated structure of rectangular cross section and having a vertically disposed inside wall 2 inches in height, a vertically disposed outside wall 2 inches in height, a top wall horizontally disposed of approximately 3½ inches in length joining the tops of such inside and outside walls, and a bottom wall horizontally disposed of approximately 3½ inches in length joining the bottoms of such inside and outside walls, a plurality of elongated apertures defined in the inside wall, each approximately ½ inch in height and 1¾ inches in length and spaced approximately 2 inches apart, and a plurality of elongated apertures defined in the outside wall, each aperture approximately ½ inch in height and 1¾ inches in length and spaced approximately 2 inches apart and spaced approximately 2 inches apart from one another, and a pair of engagement members extending upwards from said top wall and extending along the length of the conduit, each engagement member being approximately 1/10 inch in width and ¼ inch in height. Also disclosed are methods of use of such conduit.

1 Claim, 4 Drawing Sheets

BASEMENT WATER DRAINAGE CONDUIT AND METHODS OF USE THEREOF

This application claims benefit of provisional application Ser. No. 60/255,792, filed Dec. 18, 2000.

BACKGROUND OF THE INVENTION

1. Field of the Invention

The field of this invention resides in the area of basement water drainage subfloor conduits and more particularly relates to an elongated, substantially rectangular in cross section drainage conduit and the methods of use thereof.

2. Description of the Prior Art

Structures to prevent or redirect water seepage from passing into a basement through or under a foundation wall have been utilized in the past. Many of such structures utilize a barrier disposed against the foundation to direct the water down to drainage systems in the floor. Conduits have also been used that provide for water collection and for the creation of a diversion space formed at the junction of the foundation wall and footing. Some of such conduits are a substantially rectangular but the bottom portion of its inside wall, which is positioned adjacent to the foundation wall, is disposed at an angle to create such water collection space. U.S. Pat. No. 5,501,044 is an example of such prior art device.

SUMMARY OF THE INVENTION

It is a goal of this invention to provide an improved conduit and methods of use thereof to aid in draining water that might otherwise seep into basement areas. The conduit of this invention is made of a water-impermeable material and is positioned below the basement floor near, or adjacent to, the foundation wall in various single-conduit or dual-conduit arrangements, as described below. The conduit has a plurality of elongated apertures defined in its sides, as described below, and such water passes through such apertures into the conduit where it is carried by the conduit to a distant location, preventing such water from leaking into the basement.

It is a further object of this invention to teach a number of methods of installation of such conduit in various foundation configurations. Some configurations include a footing beneath the foundation wall while another teaches the use of the conduit of this invention in structures where there is no footing but merely gravel under the foundation wall and flooring. In a prime embodiment dual conduits can be utilized with the first conduit located adjacent to the foundation and the second conduit located adjacent to the footing, as described further below.

It has been found that the use of the conduit of this invention under the perimeter of a basement floor substantially simplifies the construction arrangements and yet provides good drainage to prevent water seepage into the basement. The use of the conduit of this invention can also be retrofitted into existing constructions.

DESCRIPTION OF THE PREFERRED EMBODIMENT(S)

Figure 1:
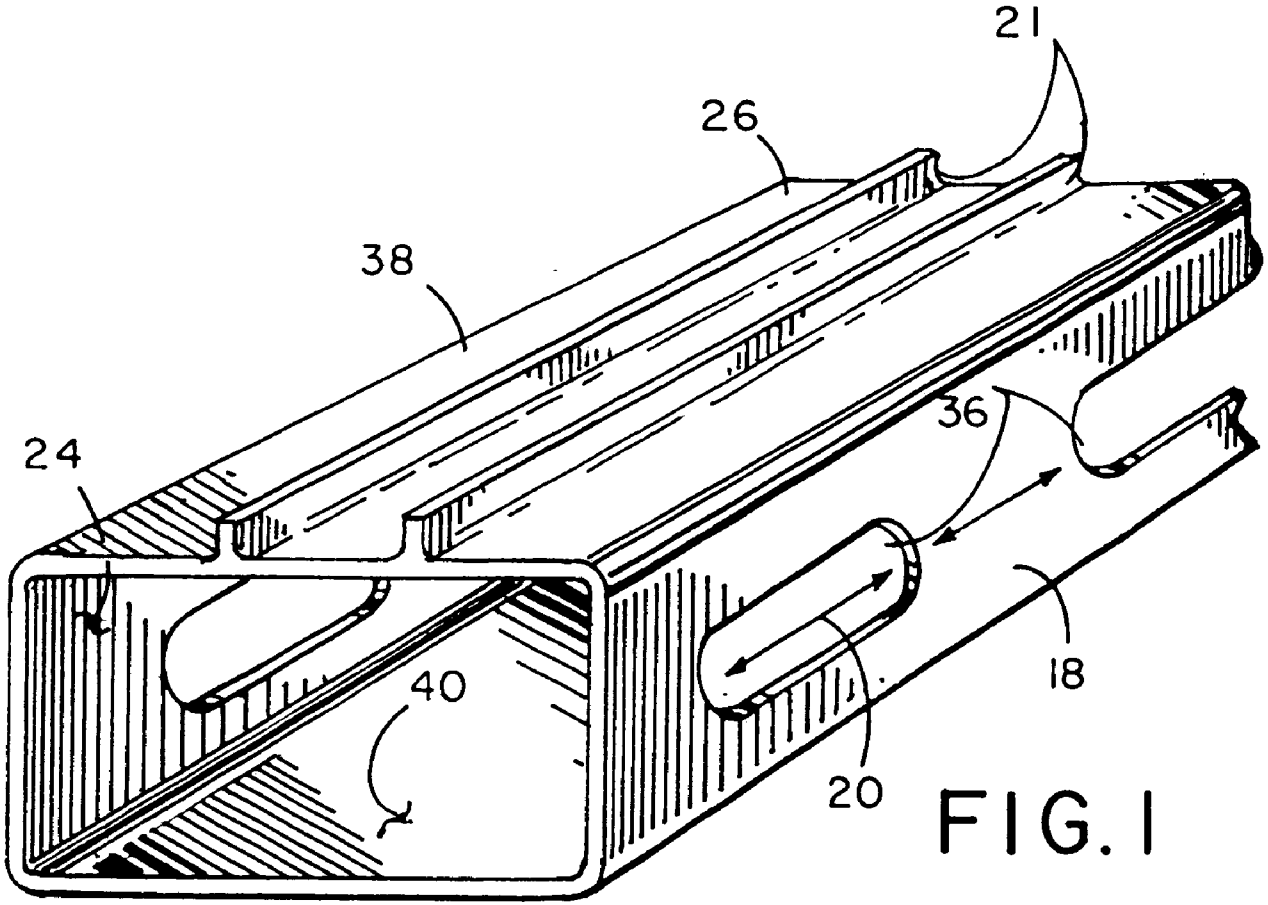
FIG. 1 illustrates a perspective view of the conduit of this invention.
Figure 2:
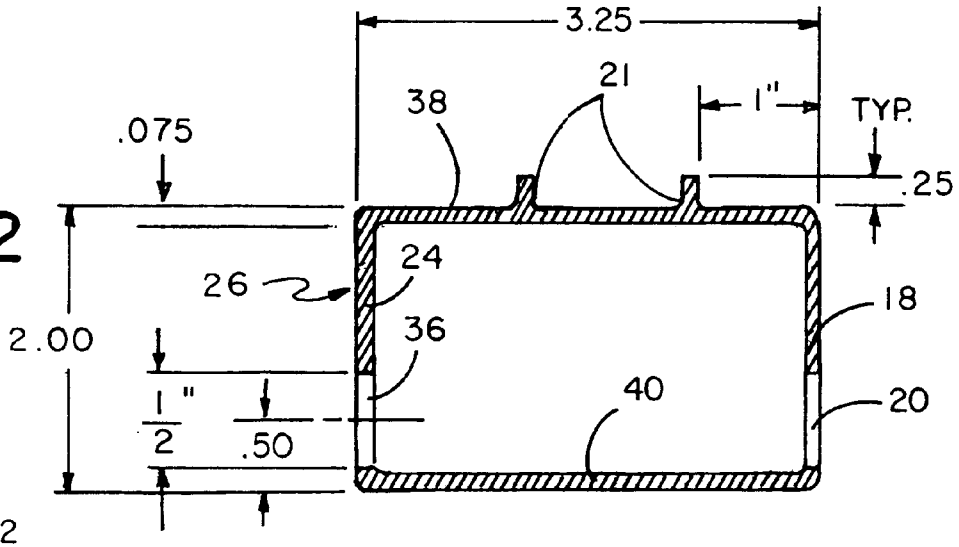
FIG. 2 illustrates a cross-sectional view through the conduit of FIG. 1.

Applicant has developed an improved basement water drainage conduit and methods of use thereof that do not require the formation of a water collection space against the foundation wall. Applicant's conduit 26, as seen in the perspective view of FIG. 1 and the cross-sectional view of FIG. 2, has top wall 38 and bottom wall 40 and is approximately 2×3¼ inches in rectangular cross-section, such conduit having spaced-apart elongated apertures 36 being approximately ½ inch high and 1¾ inches long disposed along first side 24 and approximately 2 inches apart, and similarly sized and spaced apart apertures 20 disposed along second side 18. A pair of engagement members 21 extend from top wall 38 to interlock with the poured concrete floor or other floor element. Engagement members 21 extend upwards approximately ¼ inch and are approximately 1/10 inch in width. Engagement members 21 are spaced approximately 1 inch apart and approximately 1 inch inward from the outwardly disposed first side 24 and second side 18 of conduit 26. Conduit 26 in a preferred embodiment can be made of extruded plastic.

Figure 3:
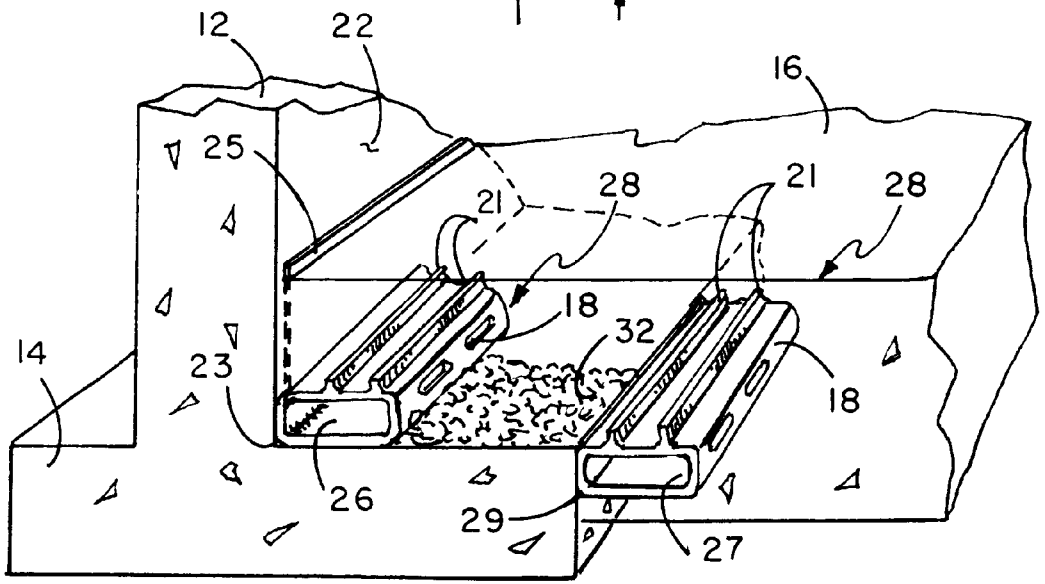
FIG. 3 illustrates a perspective view of the conduit of this invention used next to the foundation and also next to the footing.

In a first embodiment shown in FIG. 3, dual conduits can be utilized. As seen in this view first conduit 26 is placed above footing 14 adjacent to inner surface 22 of foundation wall 12 and adjacent to rubber-like sheet vapor barrier 25 which can be placed along the inner surface 22 of foundation 12. A second conduit 27 is placed immediately on the inside of inner wall 29 of footing 14. A second sheet of membrane 32 is positioned on top of footing 14 extending between first conduit 26 and second conduit 27. Such membrane can also take the form of textured cove piece material or can also be a flat rubber-like sheet of material. This embodiment is very effective in catching water that passes through foundation wall 12 and also down the inner surface of foundation wall 22 behind barrier 25 to the foundation/footing junction 23 where it passes into first conduit 26. Water also coming from footing 14 is directed away from floor 16 by membrane 32 to second conduit 27 where such water flow is then received therein and redirected by the conduit to a desired location.

Figure 4:
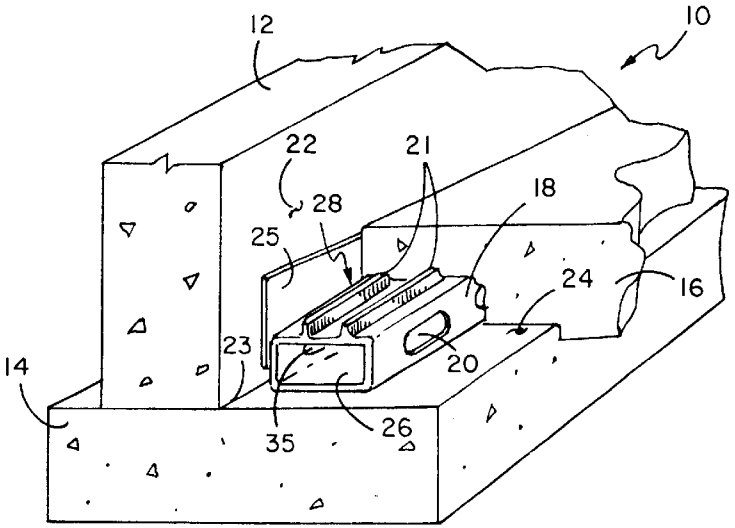
FIG. 4 illustrates a perspective view of the conduit of this invention and one method of use.

In the embodiment shown in FIG. 4 conduit 26 is shown abutting inner surface 22 of foundation wall 12 and resting on footing 14. Concrete floor 16 is poured over conduit 26 right up to inner surface 22 of foundation wall 12. Rubber-like sheet vapor barrier 25 can be disposed between conduit 26 and foundation wall 12. Barrier 25 does not extend on the way down to the foundation/footing junction 23. This methodology uses buried conduit 26 itself with its first side 24 placed flush against thin barrier 25 and foundation wall 12 to form a water collection area within the conduit to collect water seepage through and under foundation wall 12, which water passes into apertures 36 and 20 and is redirected down the length of such conduit to a remote desired location to prevent its entry into the basement.

Figure 5:
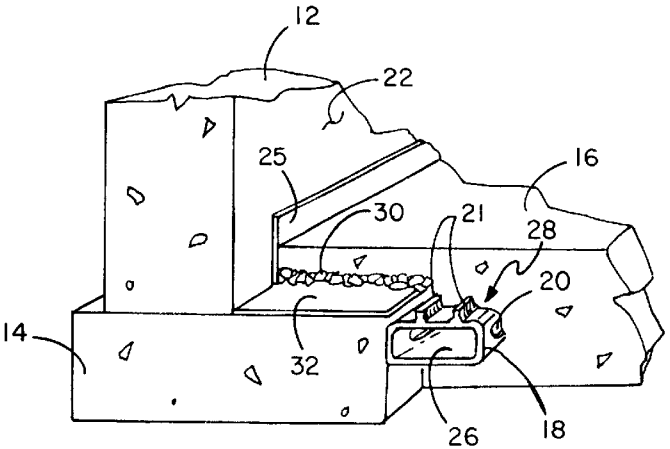
FIG. 5 illustrates a perspective view of the conduit of this invention and an alternate method of use.

FIG. 5 illustrates an alternate embodiment of the use of conduit 26 which provides for a very narrow 2-inch layer of concrete floor 16 over footing 14. This embodiment is helpful in situations where the height of existing concrete floor 16 is only a short distance above footing 14. This embodiment receives and redirects water that enters in front of footing 14 as well as over footing 14. The use of this method avoids having to use a jack hammer to remove part of the footing, the use of which would not only damage the footing, but also reduce its load-bearing capacity. In the method of this embodiment conduit 26 is installed in front of footing 14, with crushed stones 30 on membrane 32 placed above footing 14 and up to conduit 26 and with concrete floor 16 then poured over the conduit and the crushed stones. A vapor barrier 25 can be disposed between floor 16 and the inner surface 22 of foundation wall 12.

Figure 6:
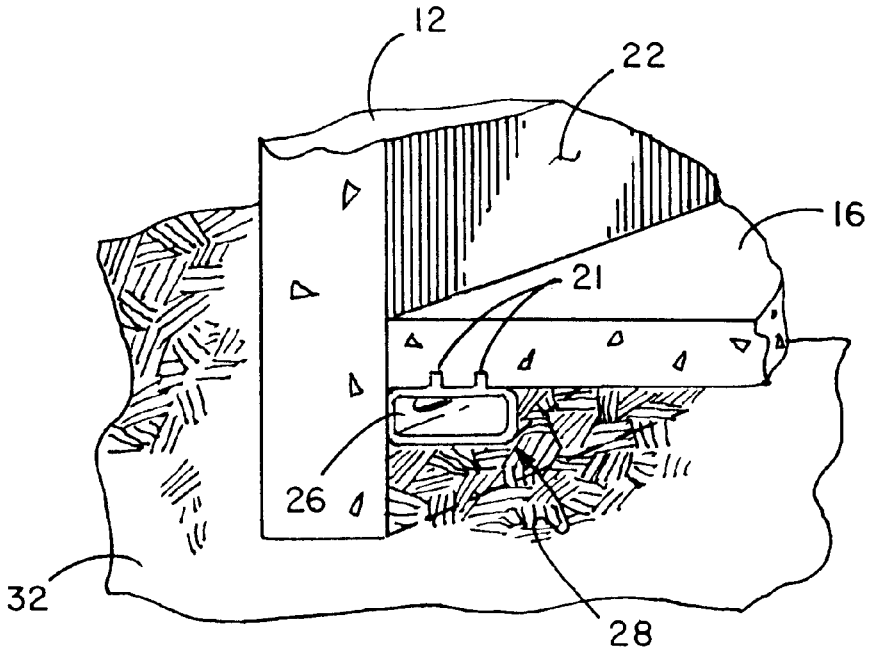
FIG. 6 illustrates a perspective view of the conduit of this invention and yet another method of use.

FIG. 6 illustrates another embodiment of the use of conduit 26 in the situation where foundation wall 12 has no footing. This embodiment can incorporate various degrees of pitch of the conduit which embodiment is useful in situations where a sump pump or discharge point cannot always be located in the lowest part of the basement. In this embodiment conduit 26 is placed in gravel 28 at the desired angle, and concrete slab floor 16 is poured thereover.

Figure 7:
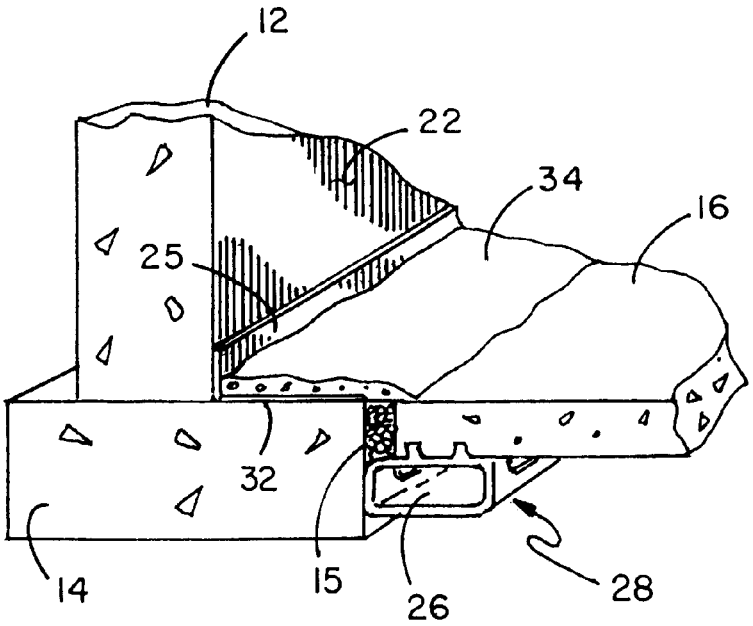
FIG. 7 illustrates a perspective view the conduit of this invention and still another method of use.

In yet another alternate embodiment of the use of conduit 26 as illustrated in FIG. 7, conduit 26 is disposed under concrete floor 16 adjacent to footing 14 where the height of floor 16 is level with the height of footing 14. A concrete berm 34 can be poured along the edge from the inner side of foundation wall 12 over crushed stones 15 located at the junction of concrete floor 16 and footing 14. In this embodiment conduit 26 can receive water both from the foundation and from in front of the footing areas. A vapor barrier 25 can be placed between concrete berm 34 and the inner surface 22 of foundation wall 12. Also a membrane sheet 32 can be positioned under berm 34 extending from the inner surface 22 of foundation wall 12 and the end of the footing to crushed stones 15.

Although the present invention has been described with reference to particular embodiments, it will be apparent to those skilled in the art that variations and modifications can be substituted therefor without departing from the principles and spirit of the invention.

I claim:

1. A conduit having a length for directing water for installation under the floor of a basement, comprising:

a unitary elongated structure of rectangular cross section having:

a vertically disposed inside wall having a top, a bottom, a height and a length;

a vertically disposed outside wall having a top, a bottom, a height and a length;

a top wall joining said tops of said inside and outside walls;

a bottom wall joining said bottoms of said inside and outside walls;

a plurality of elongated apertures each having a size defined in said inside and said outside walls;

wherein said inside and outside walls are approximately 2 inches in height, said top and bottom walls are approximately 3½ inches in length, and said elongated apertures are approximately ½ inch in height and 1¾ inches in length and are defined in said inside wall approximately 2 inches apart and defined in said outside wall approximately 2 inches apart, said apertures for receiving water from said basement into said conduit to direct said water to a collection area; and a first and a second engagement member spaced apart from one another extending upwards from said top wall along said length of said conduit for engagement with said floor wherein said engagement members are approximately 1/10 inch in width, ¼ inch in height and are spaced apart from one another 1 inch and wherein said engagement members are disposed approximately 1 inch inward from said outside wall of said conduit.

* * * * *